US007179122B2

(12) United States Patent
Holliday

(10) Patent No.: US 7,179,122 B2
(45) Date of Patent: Feb. 20, 2007

(54) UNIVERSAL CRIMPING CONNECTOR

(76) Inventor: Randall A. Holliday, 4360 Augusta Dr., Broomfield, CO (US) 80020

( * ) Notice: Subject to any disclaimer, the term of this patent is extended or adjusted under 35 U.S.C. 154(b) by 0 days.

(21) Appl. No.: 10/930,282

(22) Filed: Aug. 30, 2004

(65) Prior Publication Data

US 2005/0048836 A1 Mar. 3, 2005

Related U.S. Application Data

(63) Continuation of application No. 10/616,273, filed on Jul. 8, 2003, now Pat. No. 6,830,479, and a continuation-in-part of application No. 10/391,026, filed on Mar. 18, 2003, now Pat. No. 6,783,394.

(51) Int. Cl.
*H01R 9/05* (2006.01)

(52) U.S. Cl. ..... 439/585; 439/578

(58) Field of Classification Search ..... 439/583–585, 439/578

See application file for complete search history.

(56) References Cited

U.S. PATENT DOCUMENTS

| | | | |
|---|---|---|---|
| 3,184,706 | A | 5/1965 | Atkins |
| 3,846,738 | A | 11/1974 | Nepovim |
| 4,655,159 | A | 4/1987 | McMills |
| 4,668,043 | A | 5/1987 | Saba et al. |
| 4,902,246 | A | 2/1990 | Samchisen |
| 5,024,606 | A | 6/1991 | Ming-Hwa |
| 5,073,129 | A | 12/1991 | Szegda |
| 5,470,257 | A | 11/1995 | Szegda |
| 5,501,616 | A | 3/1996 | Holliday |
| 5,564,942 | A | 10/1996 | Lee |
| 5,586,910 | A | 12/1996 | Del Negro et al. |
| 5,667,405 | A | 9/1997 | Holliday |
| 5,863,220 | A | 1/1999 | Holliday |
| 5,899,769 | A | 5/1999 | Konetschny et al. |
| 5,997,350 | A | 12/1999 | Burris et al. |
| 6,089,913 | A | 7/2000 | Holliday |
| 6,153,830 | A | 11/2000 | Montena |
| 6,352,448 | B1 | 3/2002 | Holliday et al. |
| 6,558,194 | B2 | 5/2003 | Montena |

FOREIGN PATENT DOCUMENTS

| | | |
|---|---|---|
| GB | 2277207 | 10/1994 |

*Primary Examiner*—Truc Nguyen
(74) *Attorney, Agent, or Firm*—John E. Reilly

(57) ABSTRACT

A coaxial cable TV connector is made up of one or more crimping members having inner crimping surface portions which are preassembled onto a crimpable sleeve member of a connector body, the sleeve having an external tapered portion into which the coaxial cable is inserted so that the crimping ring(s) can be preassembled onto the sleeve and axially advanced to cause inward radial deformation of the sleeve into sealed engagement with an outer surface of the coaxial cable, and each size of connector assembly is conformable for use with more than one size of cable.

25 Claims, 6 Drawing Sheets

55
58
56
64
57

54
55
52
50
40
41
66
38
42
36
34
32

108
106
100
104
102
62
60
55
50
59
58
18
57
A
14
30
10
21
26
28
16
24
12

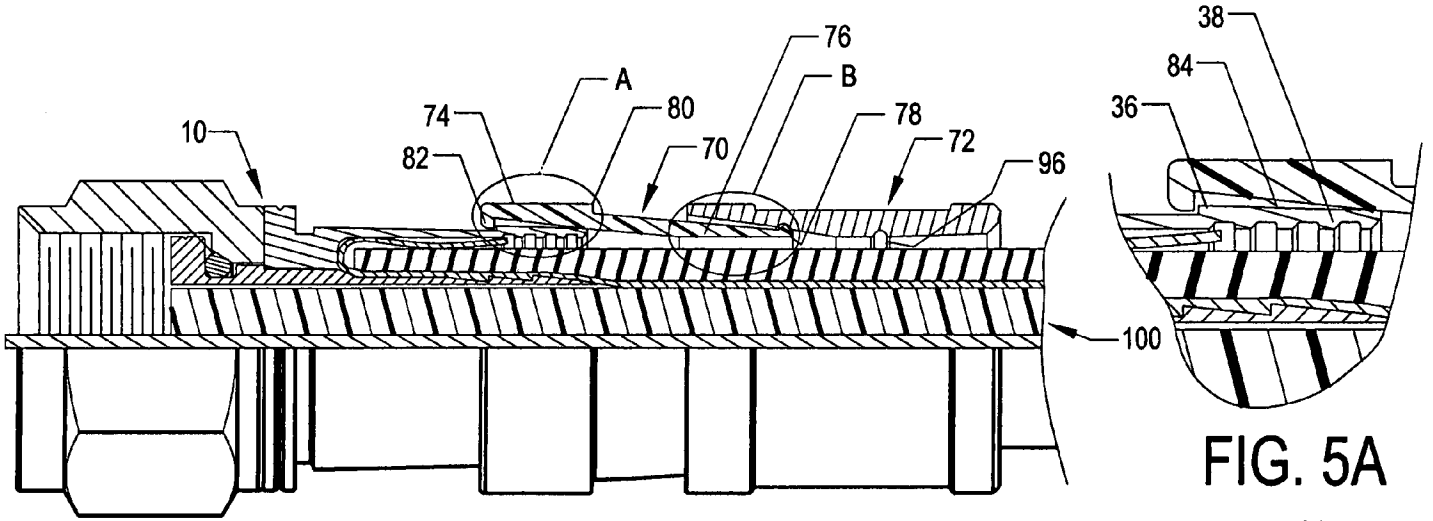
FIG. 5A
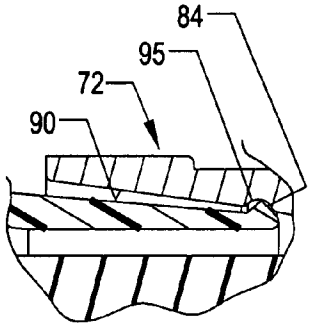
FIG. 5B
FIG. 5
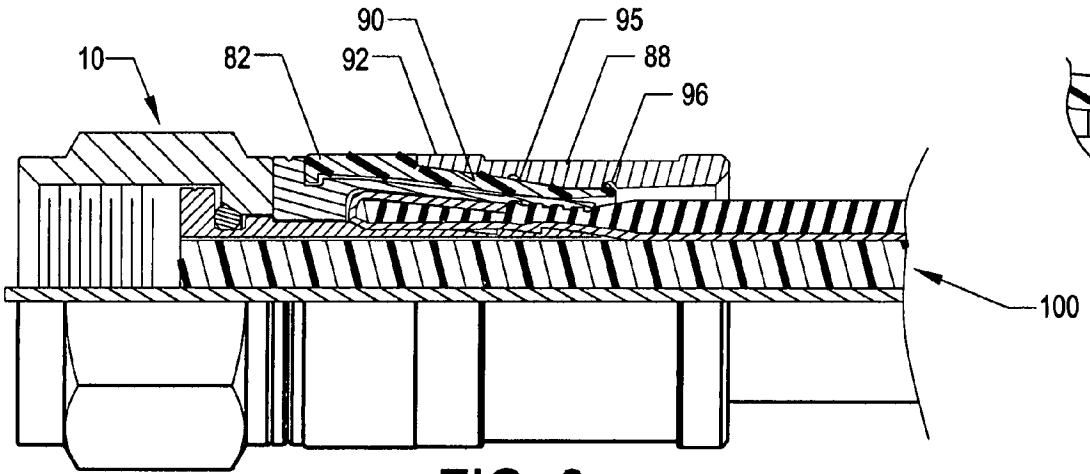
FIG. 6

UNIVERSAL CRIMPING CONNECTOR

CROSS-REFERENCE TO RELATED APPLICATIONS

This application is a continuation of patent application Ser. No. 10/616,273, filed 8 Jul. , 2003 for UNIVERSAL CRIMPING CONNECTOR by Randall A. Holliday, now Pat. No. 6,830,479, issued 14 Dec., 2004 and incorporated by reference herein; and continuation-in-part of patent application Ser. No. 10/391,026, filed 18 Mar., 2003 for UNIVERSAL MULTI-STAGE COMPRESSION CONNECTOR by Randall A. Holliday, now Pat. No. 6,783,394, issued 31 Aug., 2004 and incorporated by reference herein.

BACKGROUND

This invention relates to cable connectors; and more particularly relates to a novel and improved compression-type connector in which a single size connector is capable of accommodating different cable sizes.

A problem which has confronted the cable T.V. industry for years has been to provide a single connector size which can accommodate a plurality of different-sized cables. The standard coaxial cable is made up of a center conductor, insulated layer surrounding the conductor, foil layer, braided layer and outer jacket. This is a typical dual shield cable having a single braided layer which is the outer conductor. Depending upon the specific application and frequencies being transmitted through the cable, it is necessary to modify the thickness of the braided layers, and consequently there are dual-shield, tri-shield and quad-shield cables. In general, the higher the frequency the shorter the wavelength and therefore requires more shielding to prevent leakage. For example, the quad-shield cable has two braided layers separated by a foil layer. Also, the braided layer may vary in thickness and density depending upon the frequencies being handled.

U.S. Pat. Nos. 5,863,220 and 6,089,913 are incorporated by reference herein and disclose coaxial cable connectors that have a crimping ring preassembled onto the connector, and the end of the cable has to be inserted through the single crimping ring and into the inner concentric sleeves on the connector. There are definite size limitations imposed on the diameter of the crimping ring to ensure that it is small enough in diameter to effect the necessary inward contraction on the outer sleeve of the connector to result in a good crimp. This means that the pull-out force necessary to separate the cable from the connector is in excess of 40 psi, and the cable should be contracted enough to assure that there is substantially no leakage or frequency loss between the braided layer(s) and the connector. At the same time, the degree of compression must not be so great as to cause the inner sleeve to collapse or be damaged or otherwise result in an impedance problem in the higher frequency ranges. Especially in larger cables, there is real difficulty in reaching a compromise between the optimum inner diameter of the crimping ring which will permit the cable to be easily inserted into the connector sleeve and the size necessary to effect a good crimp. Since the crimping is most important to assure a good connection, typically the inner diameter of the crimping ring is such that it is very difficult to insert the cable into the connector sleeve. This requires manual dexterity on the part of the installer and, after a day of making connections, can be extremely time-consuming, difficult and very tiring.

Accordingly, for professional and residential installations alike, it is desirable to provide a preassembled crimping ring assembly for a compression-type connector which is conformable for use with a wide range in sizes of coaxial cables either for the purpose of splicing cables together or for connecting one cable end to a terminal and nevertheless be capable of achieving the desired sealed mechanical and electrical connection therebetween.

SUMMARY

It is an object to provide for a novel and improved compression-type connector which is employs a single crimping member but nevertheless is capable of connecting different size cables either to a terminal or to another connector in an efficient and reliable manner.

Futher, it is desirable to provide for a novel and improved end connector for coaxial cables with a self-contained crimping ring to achieve the necessary sealed mechanical and electrical connection between the cable and the terminal or to another cable; and wherein the crimping ring assembly is so constructed and arranged as to bring about the necessary inward radial deformation or compression of the connector into crimping engagement with the cable in response to axial advancement of the crimping ring assembly with existing compression tools.

A further aspect is to provide for a novel and improved cable connector with pre-assembled crimping ring which will effect sealed engagement between the connector and cable in a minimum number of steps and simplified manner.

In one embodiment, a connector fitting has been devised for connecting a cable having an electrically conductive member to another electrically conductive member, the fitting comprising a sleeve member of a continuous cylindrical configuration sized for insertion of an end of the cable therein, and a cylindrical crimping member having at least one inner tapered annular surface portion dimensioned to advance over the sleeve member, the inner tapered annular surface portion being disposed in close-fitting engagement with the sleeve member whereupon axial advancement of the crimping member along the sleeve member will impart inward radial deformation to the sleeve member into sealed engagement with an external surface portion of the cable. Preferably, the sleeve member includes an outer rearwardly tapered wall portion substantially complementary to the inner tapered annular surface portion of the crimping member, and releasable locking means are disposed between the sleeve member and crimping member for releasably mounting the crimping member in preassembled relation to the sleeve member. In a second embodiment, the releasable locking means includes a first locking member projecting radially inwardly from the inner tapered annular surface portion of the crimping member and a second locking member projecting radially inwardly from an external wall surface of the sleeve member.

A crimping member is preferably designed with an inner tapered annular surface portion which has a progressively increasing tapered angle rearwardly from the leading end of the crimping member, and the sleeve member has an external wall surface which diverges forwardly away from the entrance end of the sleeve and is substantially complementary to the inner tapered annular surface portion of the crimping member.

The embodiments described are adaptable for use with coaxial TV cables for terminating different size cables depending upon the particular application and frequency being transmitted and, to this end, the inner tapered annular surface portion of the crimping member has a diameter at least as great as the outer diameter of the sleeve in order to be preassembled onto the sleeve and tapers to a second inner diameter less than the outer diameter of the sleeve but greater than the diameters of the cables to be inserted therein.

In a two-stage connector embodiment, a pair of crimping rings are arranged in telescoping relation to one another and to the sleeve, the first crimping ring having an inner tapered annular surface portion adapted to advance over the outer surface of the sleeve member as in the first form of invention described herein, and the second crimping member also having an inner tapered annular surface portion so that when the crimping rings are axially advanced over the outer sleeve will cause inward radial deformation of the sleeve into sealed engagement with an external surface of the cable.

There has been outlined, rather broadly, the more important aspects in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 5 is a view partially in section of another embodiment of a connector assembly;

FIG. 5A is a detailed view taken at A of FIG. 5 with a first crimping ring partially advanced over the sleeve of the connector;

FIG. 5B is a detailed view taken at B of FIG. 5 of a second crimping ring partially advanced over the first crimping ring;

FIG. 6 is another view of the form of invention shown in FIG. 5 with a first crimping ring fully advanced over the sleeve of the connector.

DETAILED DESCRIPTION OF FIRST EMBODIMENT

Figures 1, 1A, 1B:
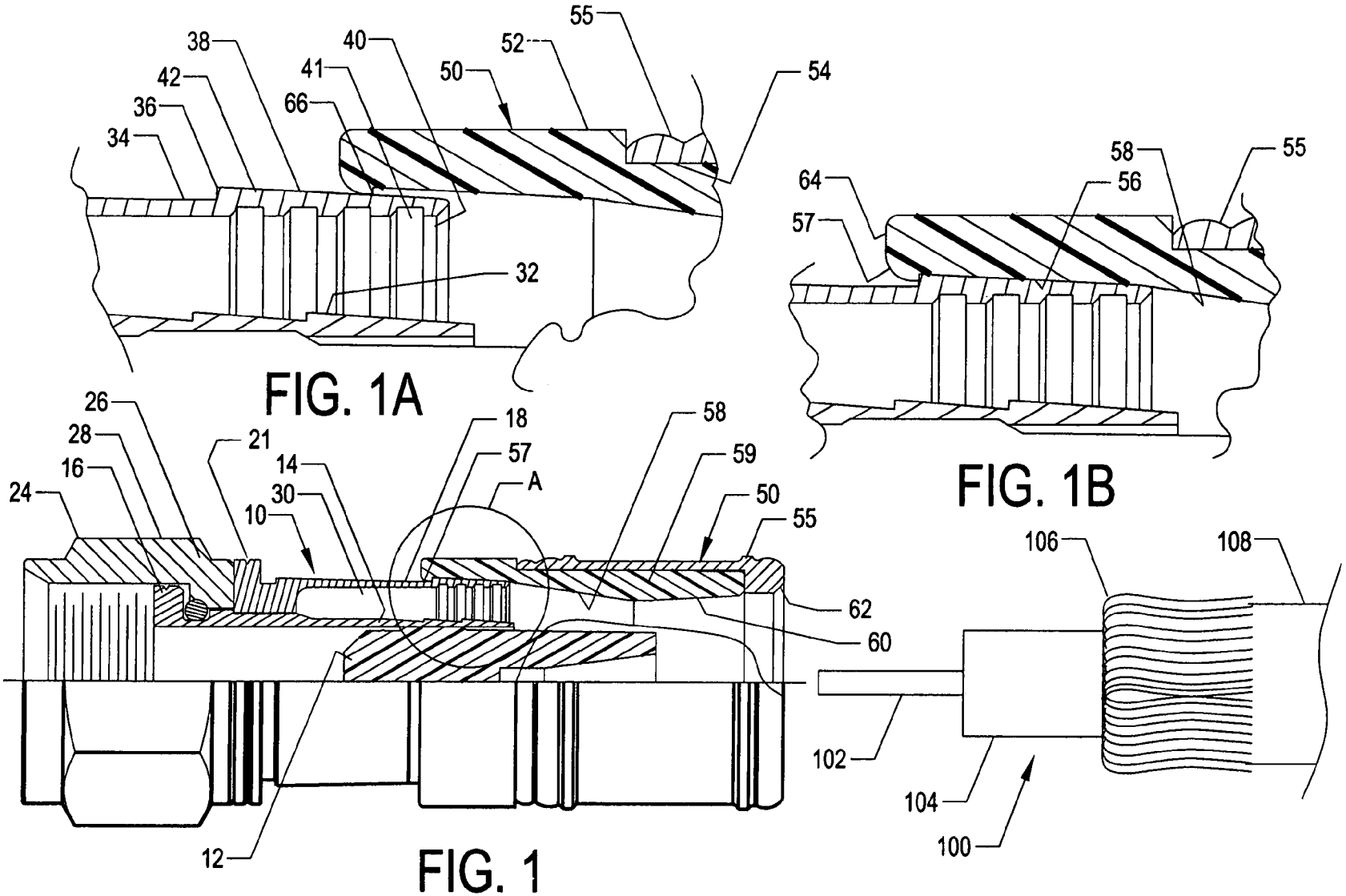
FIG. 1 is an elevational view partially in section of one form of connector assembly in accordance with one embodiment.
FIG. 1A is a detailed view taken at A in FIG. 1 showing a connector partially inserted into a crimping ring.
FIG. 1B is a detailed view taken at A in FIG. 1 after the crimping ring has been advanced into a preassembled position.
Figure 2A:
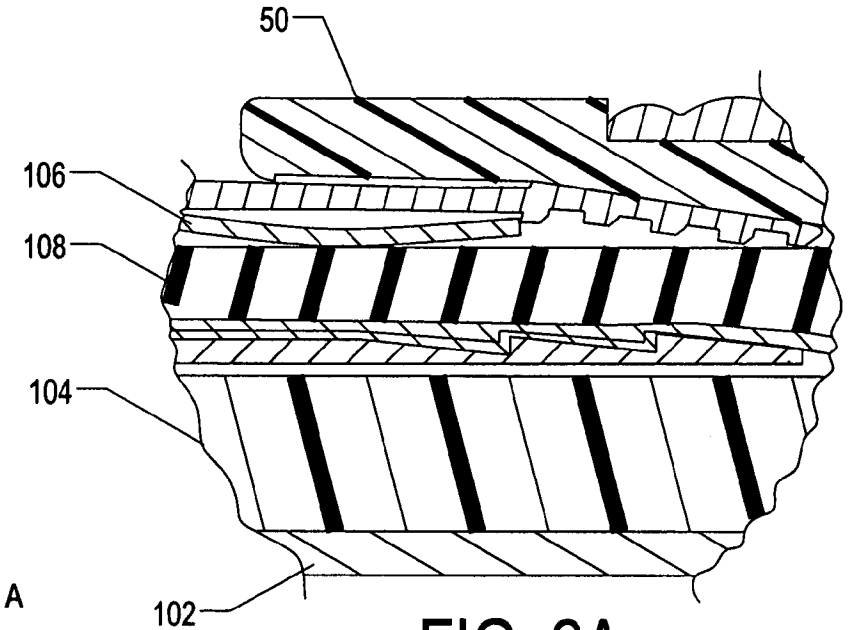
FIG. 2A is a detailed view taken at A in FIG. 2.
Figure 2:
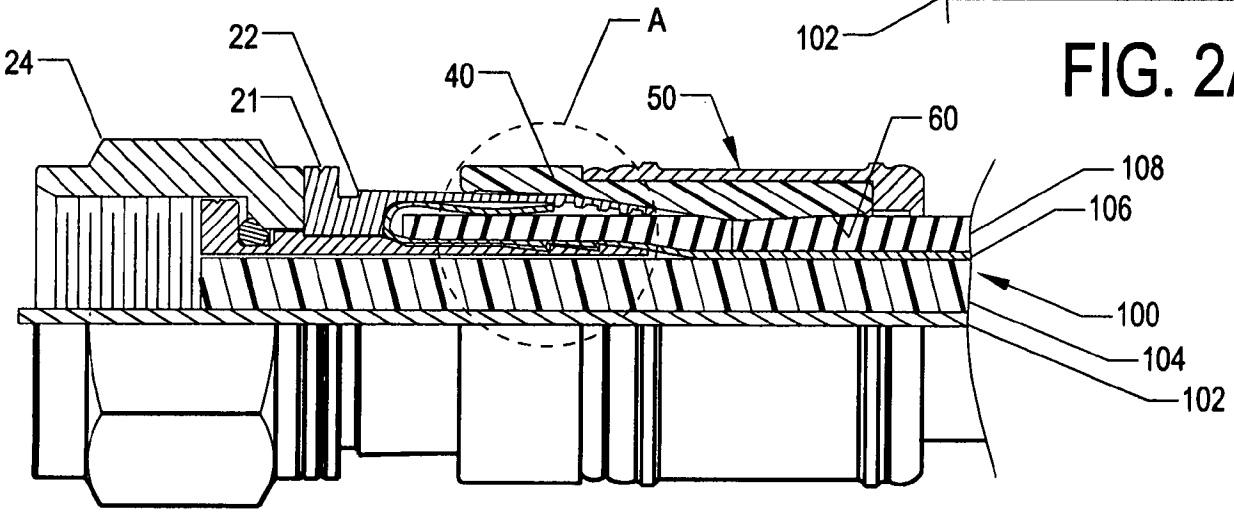
FIG. 2 is another elevational view partially in section of the form of invention shown in FIG. 1 after continued advancement of the crimping ring over the sleeve.
Figure 3A:
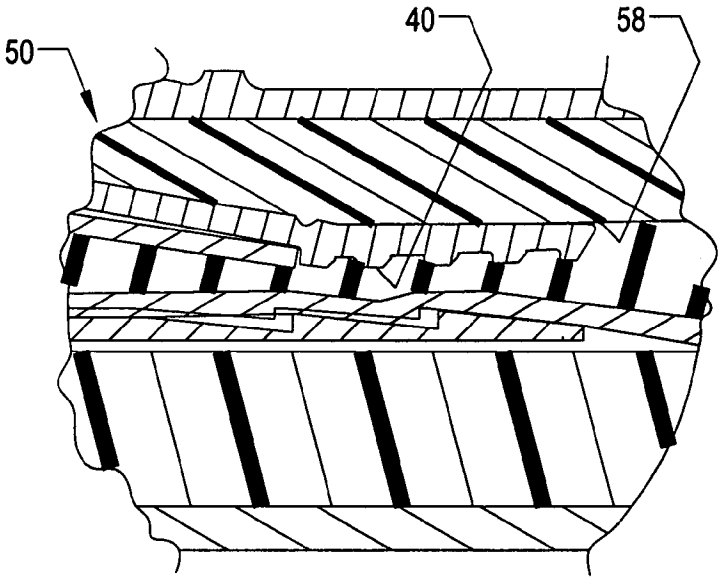
FIG. 3 is another elevational view partially in section of the form of invention shown in FIGS. 1 and 2 after continued advancement of the crimping ring into the fully closed position with the connector sleeve.
Figure 3:
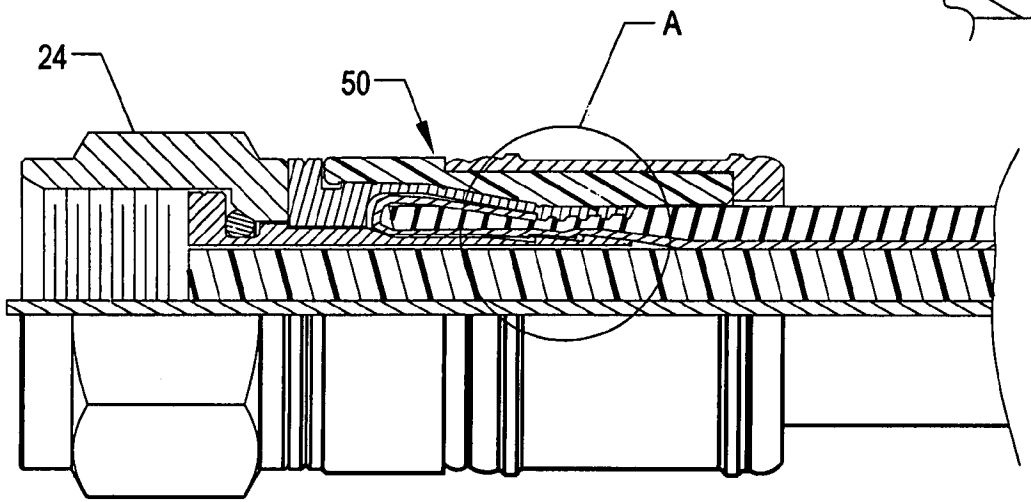

Referring in detail to the drawings, there is illustrated in FIGS. 1 to 3 an end connector 10 which is adapted for connecting a standard coaxial cable 100 to a television terminal. FIG. 1 illustrates the connector 10 in the open or preassembled position with a standard coaxial cable 100 aligned with a starter guide 12 which aids in aligning the cable for insertion into the connector as illustrated in FIG. 2. The starter guide 12 is illustrated and described in more detail in U.S. Pat. No. 6,352,408 for CABLE TV END CONNECTOR STARTER GUIDE and is incorporated by reference herein. A crimping ring 50 is preassembled onto one end of the connector 10 prior to insertion of the cable 100.

The end connector 10 is broadly made up of an inner concentric sleeve 14 having an external shoulder 16 at its forward end, and an outer concentric sleeve has an external shoulder 21 and an external groove 22. A threaded fastener 24 has a rearward end 26 which is interpositioned between the shoulders 16 and 21, and the fastener 24 is internally threaded for connection in a well-known manner to a post or terminal on a television set. An exterior surface of the fastener 24 is provided with suitable flats 28 to facilitate engagement by a tool, such as, a crescent wrench, and the rear end portion 26 enables the fastener 24 to be rotated independently of the rest of the connector. The inner sleeve 14 and outer sleeve 18 are substantially coextensive and extend rearwardly in spaced concentric relation to one another so as to form an annular space 30 therebetween for insertion of the cable in a manner to be described. The inner concentric sleeve 14 is of substantially uniform diameter but with a slight rearward taper and includes a plurality of axially spaced, annular serrations 32 toward the rearward end along its inner wall surface. The outer sleeve 18 extends rearwardly to a point slightly less than the rearward end of the inner sleeve 14 and includes a thin-walled section 34 of a substantially uniform thickness and terminating in an external shoulder 36, the shoulder 36 being at the forward end of a sealing ring section 38 of the outer sleeve. The section 38 is thicker than the section 34 and has a plurality of axially spaced sealing rings 40 along its inner surface which are constructed in accordance with the teachings of U.S. Pat. No. 5,501,616 and which project radially inwardly from inner wall surface 41 of the section 38. An external wall surface 42 of the section 38 extends rearwardly from the shoulder 36 and is tapered rearwardly; also, the inner surface 41 tapers toward the outer wall surface in a rearward direction or in other words diverges in a radial outward direction as it progresses rearwardly away from the intermediate section 18. By virtue of the rearward taper between the inner and outer walls 41 and 42 results in a thickened cross-section of the sleeve at or just rearwardly of the shoulder 36 for a purpose to be described.

In accordance with the present invention, a single crimping ring member 50 includes an outer wall 52 having an inset portion 54 to receive a band 55, the outer surface of which is flush with the outer wall 52 and includes a first forwardly tapered inner wall surface 56 which terminates in a generally circular rib 57 projecting radially inwardly from the leading or forward end of the crimping member 50. A second forwardly tapered inner wall surface 58 is of an increased tapered angle relative to the first inner tapered wall surface 56 and intersects a rearwardly tapered third inner wall surface 60, the latter terminating in a beveled end surface 62.

Figure 7:
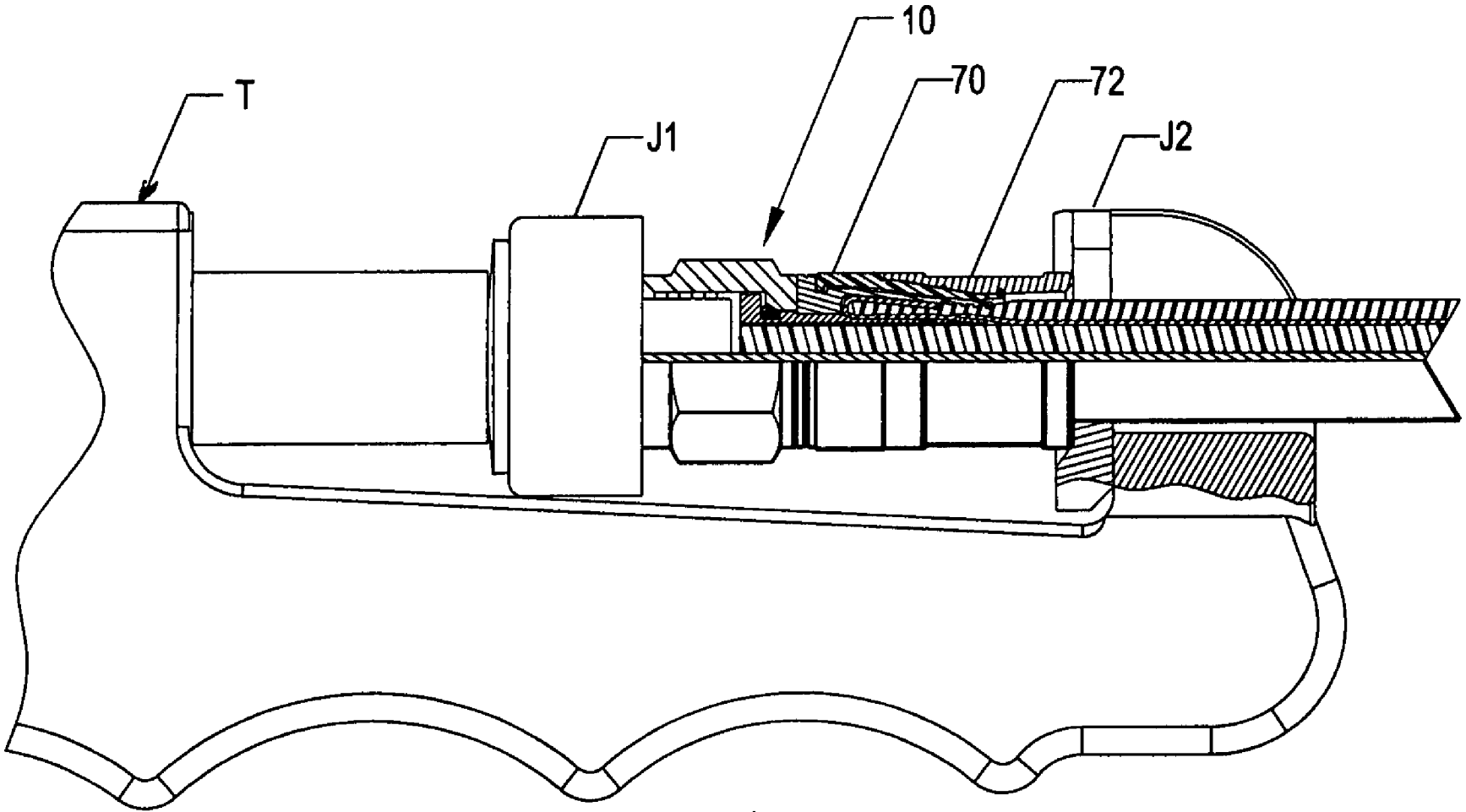
FIG. 7 is another view of the form of invention of FIGS. 5 and 6 with a second crimping ring fully advanced over the first crimping ring into a closed position.

The rib 57 forms an inward radial continuation of a rounded leading end portion 64 and terminates in an internal shoulder 66. The crimping ring 50 is preferably composed of a plastic material with sufficient resiliency that the rib 57 is compressible when it is forced over the external tapered wall 38 of the outer sleeve 18 and, upon moving into alignment with the external shoulder 36, the rib will expand so as to fit snugly in place against the shoulder 36 and prevent accidental loosening or removal of the crimping ring 50 from the connector 10. The first inner tapered wall surface 56 is tapered at an angle substantially corresponding to the angle of taper of the wall 42 of the sleeve 18, as best seen from FIG. 1A, and will move into snug-fitting engagement with the external wall 42 after the rib 57 has advanced into engagement with the shoulder 36, as best seen from FIG. 1B. Axial advancement may be done with a standard compression tool, such as, that disclosed in U.S. Pat. No. 6,089,913, or as shown in FIG. 7. The outer sleeve 18 is composed of a material, such as, brass which will resist any radial compression as the rib 58 is advanced over the wall surface 42. However, the crimping ring 50 is of sufficient hardness along the tapered wall surfaces 56 and 58 as to cause the sleeve 18 to be deformed radially inwardly. Although the first tapered wall surface 56 is dimensioned to exert little, if any, inward radial pressure on the outer sleeve 18 at least until the end of its advancement into the assembled position shown in FIG. 1B, continued axial advancement as illustrated in FIGS. 2 and 2A will impart increasing inward radial pressure to the rear section 38 of the sleeve 18 causing it to be deformed radially inwardly. Inward radial compression is increased by the continued advancement of the second inner tapered surface portion 60 over the rear section 38 of the sleeve 18, as shown in FIGS. 3 and 3A, until the rib 58 moves into engagement with the groove 22 at the leading end of the sleeve 18. As shown, the degree of inward compression or crimping of the sleeve 18 is at its greatest along the thickest portion of the tapered wall section 38, and the sealing rings 40 will be forced radially inwardly to a greater extent into engagement with the outer jacket of the cable at the thickest portion nearer to the shoulder 36 than at the opposite end where the section 38 is much thinner.

A standard form of coaxial cable 100 is illustrated in FIGS. 1 through 3 which is made up of an inner conductor 102, dielectric insulator 104, outer braided conductor layer 106, and a dielectric outer jacket 108. Typically, foil layers, not shown, are interposed between the insulator 104 and layer 106 as well as between the braided layer 106 and the jacket 108. The end of the cable 100 to be inserted into the connector 10 is prepared by removing portions of the insulator 104, layer 106 and jacket 108 from the end of the cable to expose an end portion of the conductor 102. Also, a portion of the braided layer 106 which extends beyond the jacket 108 is peeled back over a leading end of the jacket 108, as best seen from FIGS. 2 and 3. Cable diameters or sizes vary according to the application and the frequencies transmitted through them, for example, when used to connect to a TV terminal or post. Typically, one or more braided layers 106 are employed depending upon the frequencies handled and can result in a variation in diameter of the cable 100 on the order of 0.024 in.

It is desirable to form a rearward taper diverging outwardly along the wall surface 60 and terminating in a beveled end 62 to guide each cable into the assembled position shown in FIG. 2, the braided layer 106 being doubled over the jacket 108 and terminating at a point just short of the first of the sealing rings 40. Further, as described in my hereinbefore referred to patent application for UNIVERSAL MULTI-STAGE COMPRESSION CONNECTOR, as a rule of thumb, the inner diameter of the crimping ring 50 must be at least as great at its leading end as the outside diameter or size of the cable 100 but taper rearwardly to a diameter less than the diameter of the inner wall of the sleeve 18 of the connector. For that reason, the degree of taper of the inner tapered wall surfaces 56 and 58 must establish a reduction in diameter from the leading end just rearwardly of the rib 57 which meets or exceeds the difference in diameter between the outer wall of the section 38 at its rearward or entrance end and the inner diameter of the section 38 at its thickest point, as previously described, in order to ensure that the sealing ribs 40 will be compressed into sealed engagement with the jacket 108 of the cable 100. As illustrated in FIGS. 1 to 3, most desirably the leading end of the inner tapered wall surface 56 is of a slightly greater diameter than the outer diameter of the rearward or entrance end of the section 38 so that the inner tapered wall surface 56 will not start to contact the outer diameter of the section 38 until it has been advanced approximately half way along the section 38. However, the rib 57 is of a reduced diameter with respect to the outer wall of the section 38 but nevertheless is of limited cross-section and sufficiently compressible as to slide over the outer wall surface 42 of the section 38. As a result of the spacing between the inner wall 56 and outer wall 42 less force is required for the compression tool T, as shown in FIG. 7, to initially slide the crimping ring 50 into the preassembled position shown in FIG. 1B.

In a typical installation procedure, the leading end of the cable 100 is prepared as described with the braided layer 106 folded over the leading end of the jacket 108. The crimping ring 50 will have been mounted as described in the preassembled position shown in FIGS. 1 and 1B; and the leading end of the cable 100 is then inserted through the crimping ring into the annular space 30 between the inner and outer sleeves 14 and 18, as shown in FIG. 2. A standard compression tool T, such as, that illustrated in FIG. 7 is provided with jaws $J_1$ and $J_2$ which are opened wide enough to permit insertion of the preassembled connector 10, crimping ring 50 and cable 100 between the jaws. By means of a lever arm on the tool, not shown, an axial compressive force is applied to advance the crimping ring 50 from the position shown in FIG. 2 to the closed position shown in FIG. 3 during which the first and second tapered surfaces 56 and 58 will have exerted a progressively increasing compressive force on the wall section 38 and causing the sealing ribs 40 to be deformed radially inwardly into sealed engagement with the outer jacket as shown in FIG. 3A. Typically, the jacket is made of a rubber or rubber-like material or other resilient material which will fill the grooves 41 between the sealing ribs to an extent sufficient to form a water tight seal between the axially spaced annular sealing ribs 40. It will be evident that the tapered surfaces 56 and 58 will impart some degree of inward radial deformation to the sleeve 18 forwardly of the section 38 so that it will assume the configuration illustrated in FIG. 3 and cause the folded-over braided layer 106 to be in firm contact with the inner and outer sleeves 14 and 18.

MODIFIED EMBODIMENTS

Figure 4:
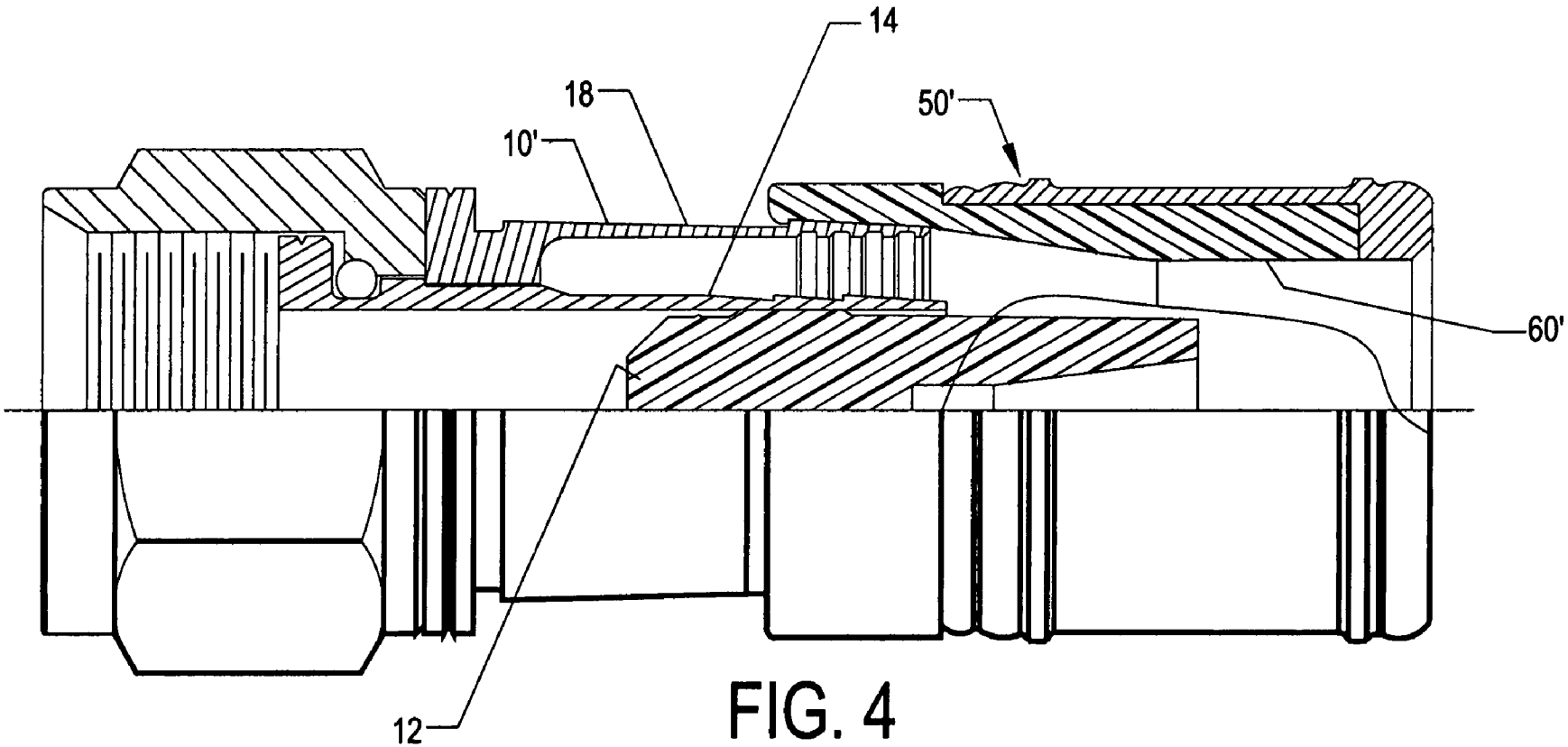
FIG. 4 is another view partially in section of a modified form of invention in which the rearward end of the crimping ring is a straight cylinder or constant inner diameter.

FIG. 4 illustrates an alternate form of connector 10' in which like parts are correspondingly enumerated to those of FIGS. 1 to 3. Specifically, the connector 10' is constructed in the same manner as the connector 10, and a crimping ring 50' is preassembled onto one end of the connector 10'. The crimping ring 50' is identical to the crimping ring 50 except that the inner wall 60' is of a uniform diameter rather than being tapered toward the entrance end as in FIGS. 1 to 3. Accordingly, the entrance end for insertion of a cable 100 does not afford the same clearance for advancement of the cable 100 into the connector. However, the wall surface 60' will maintain a greater degree of pressure on the sleeve section 38 once the crimping operation is completed.

Another modified form of compression connector assembly is shown in FIGS. 5 and 6 wherein a pair of crimping rings 70 and 72 have been devised in place of a single crimping ring 50, as shown in FIGS. 1 to 3, in attaching the end of a standard coaxial cable 100 to a connector 10. Accordingly, like parts to those of FIGS. 1 to 3 are correspondingly enumerated with respect to the cable 100 and connector 10, and the crimping rings 70 and 72 are preassembled in axially offset relation to one another and to the outer sleeve 18 of the connector 10. The first crimping ring 70 includes a cylindrical portion 74 which is enlarged or thickened with respect to a relatively thin-walled cylindrical portion 76 which tapers rearwardly from the portion 74 and terminates in a trailing end 78. The cylindrical portion 74 defines an external shoulder 80 at its juncture with the thin-walled portion 76, and the portion 74 has a circumferential rib 82 at its leading beveled end which extends radially inwardly for engagement with the outer wall surface of the rear section 38 of the connector sleeve 18. In particular, it will be noted that the inner wall surface 84 tapers rearwardly from a diameter greater than that of the outer surface 42 of the rear section 38 to a diameter approximately the same as the inner diameter of the rear section 38.

The first crimping ring member 70 is preferably composed of a plastic material, such as, DELRIN® having sufficient resiliency as well as compressibility that the leading end can be expanded slightly to permit the rib 82 to slide over the external surface of the rear section 38 and snap into position against a shoulder 36. The elongated tapered portion 76 terminates in a radially outwardly projecting rib 84 at its trailing edge 78, as best seen from FIG. 5B.

The second crimping ring 72 includes an annular body 88 having a forwardly tapered inner wall surface 90 between a relatively thick-walled portion 88 at its rearward end and a thin-walled leading end portion 92. The leading end 92 and inner tapered wall surface 90 are dimensioned to fit snugly over the trailing end 78 of the first crimping member 70 when assembled onto the connector 10. A circumferential groove 95 in the tapered wall surface 90 is adapted to receive the rib 84 on the first crimping member 70 to releasably connect the crimping rings 70 and 72 together when preassembled onto the connector 10, as best seen from FIG. 5B. A second groove 96 is axially spaced from the first groove 95 to engage the rib 84 when the second crimping ring 72 is axially advanced over the first crimping ring 70 between the position shown in FIG. 5 and that shown in FIG. 6.

In practice, the rings 70 and 72 are preassembled onto the connector 10 such that the rib 82 is advanced into engagement with the shoulder 36 and the groove 95 is advanced into alignment with the rib 78. The cable 100 is prepared with the braided layer 106 folded over the leading end of the jacket 108 and inserted through the crimping rings 70 and 72 into the annular space 30 between the inner and outer sleeves 14 and 18, as shown in FIG. 5. A hand-operated crimping tool T as illustrated in FIG. 7 is opened to permit insertion of the connector 10 between the jaws $J_1$ and $J_2$, and an axial compressive force is applied to advance the crimping rings 70, 72 over the sleeve 18 until the rib 82 moves into engagement with the groove 22 and the crimping ring 72 slides over the crimping ring 70 until the second groove 96 moves into engagement with the rib 78. Progressive advancement of the crimping rings 70 and 72 along the rear section 38 of the connector 10 will impart inward radial deformation to the section 38 causing it to be deformed radially and inwardly into engagement with the jacket 108, and the resilient material of the jacket will fill the grooves between the sealing rings 40 so as to effect a water-tight seal.

From the foregoing, it will be appreciated that the two-stage compression connector of FIGS. 5 and 6 with a pair of crimping rings in axially offset relation to one another will impart a progressive crimping action to the connector in very much the same manner as the single stage compression connectors of FIGS. 1 to 4. One difference is that the two-stage compression connector requires that the second crimping ring impart crimping action by compressing the first crimping ring against the connector sleeves 14 and 18 whereas the single stage connector of the embodiments of FIGS. 1 to 4 will impart a progressively increased compressive force directly to the connector sleeves 14 and 18. For this reason, most desirably in the single stage connector of FIGS. 1 to 4, the main body 59 of the crimping ring 50 is composed of a plastic material as referred to earlier and the outer band or liner 55 is composed of a metallic material and terminates in the relatively thick beveled end 62; whereas in the two-stage compression connector of FIGS. 5 and 6, the first or inner crimping ring 70 is composed of plastic and the second or outer crimping ring 72 composed of a metallic material of sufficient strength and hardness as to be capable of compressing the crimping ring and deform the sleeve member 18 radially inwardly into sealed engagement with the jacket 108 as previously described. Another advantage of the single stage compression connector is that it will permit utilization with multiple sizes of cables although not to the same degree as the multi-stage compression connector depending upon the degree of compression required to effect the necessary sealed engagement.

It is therefore to be understood that while alternate embodiments are herein set forth and described, the above and other modifications may be made therein without departing from the spirit and scope of the invention as defined by the appended claims and reasonable equivalents thereof.

I claim:

1. A multi-stage connector for mechanically and electrically connecting a cable having a first electrically conductive member to a second electrically conductive member, said connector comprising:

a connector body;

an outer sleeve member extending from an end of said connector body for insertion of an end of said cable therein;

a first crimping member having a first inner crimping surface portion including a first inner diameter at least as great as an outer diameter of said outer sleeve member and disposed in outer surrounding and slidably engaging relation to said outer sleeve member; and a second crimping member having a second inner crimping surface portion at least partially overlying said first crimping member wherein slidable axial advancement of said second crimping surface portion and said first crimping surface portion with respect to said outer sleeve member will impart inward radial deformation to said outer sleeve member into crimping engagement with an external surface of said cable.

2. A connector according to claim 1 wherein said first inner crimping surface portion extends from a first diameter at least as great as an outer diameter of said outer sleeve member to a second diameter less than said outer diameter of said outer sleeve member.

3. A connector according to claim 1 wherein said first inner crimping surface portion extends from said first diameter to a second diameter less than said outer diameter of said outer sleeve member but greater than an inner diameter of said outer sleeve member.

4. A connector according to claim 1 wherein said first crimping member includes an external shoulder at a leading end thereof.

5. A connector according to claim 4 wherein said second crimping member includes a leading end portion moveable into abutting relation to said shoulder in response to axial slidable advancement of said crimping member with respect to said crimping member.

6. A connector according to claim 1 wherein said first crimping member and said outer sleeve member have releasable connecting means therebetween whereby to releasably connect a leading end portion of said first crimping member to a trailing end portion of said outer sleeve member.

7. A connector according to claim 1 wherein said first and second crimping members undergo successive axial advancement in the same direction with respect to said outer sleeve member.

8. In a connector for connecting a coaxial TV cable to a terminal wherein said cable has an outer resilient jacket, inner and outer spaced electrically conductive portions and wherein said connector has a fastener for connection to said terminal and a body provided with inner and outer concentric sleeve members with axially spaced sealing ribs on an inner surface of said outer sleeve member for insertion of said inner electrically conductive portion within said inner sleeve member and insertion of said outer electrically conductive portion and said jacket between said inner sleeve members and said outer sleeve member, the improvement comprising:

a first crimping member having a first inner crimping surface portion including a first inner diameter at least as great as an outer diameter of said outer sleeve and a leading end portion disposed in outer surrounding and slidably engaging relation to a trailing end portion of said outer sleeve member; and a second crimping member having a second inner crimping surface portion extending rearwardly from a first diameter at least as great as an outer diameter of said first crimping member to a second diameter less than said outer diameter of said first crimping member but greater than said inner diameter of said outer sleeve member wherein slidable axial advancement of said second crimping member and said first crimping member with respect to said outer sleeve member will impart progressive inward radial deformation to said first crimping member and resultant inward radial deformation of said sealing ribs into sealed engagement with said outer resilient jacket.

9. In a connector according to claim 8 wherein said first crimping member includes an external shoulder portion at a leading end thereof, and said second crimping member includes a leading end portion movable into abutting relation to said external shoulder portion when said second crimping member is axially advanced with respect to said first crimping member.

10. In a connector according to claim 9 wherein said first crimping member and said outer sleeve member have first releasable connecting means therebetween for releasably connecting said first crimping member to an outer surface of said outer sleeve member.

11. In a connector according to claim 10 wherein said first and second crimping members have second releasable connecting means therebetween for connecting a leading end portion of said second crimping member to a trailing end portion of said first crimping member.

12. A fitting for connecting a cable having an electrically conductive member to another electrically conductive member, said fitting comprising:

an outer sleeve member of a continuous cylindrical configuration sized for insertion of an end of said cable therein, said sleeve member having a thin-walled portion of substantially uniform diameter and a relatively thick portion tapering away from said thin-walled portion;

an inner sleeve member in inner spaced concentric relation to said outer sleeve member; and a cylindrical crimping member having at least one inner crimping surface portion dimensioned to advance over said sleeve member, said inner crimping surface portion disposed in close-fitting slidable engagement with said outer sleeve member whereupon axial advancement of said crimping member along said outer sleeve member will impart inward radial deformation to said outer sleeve member into sealed engagement with an external surface portion of said cable.

13. A fitting according to claim 12 wherein said cable is insertable between said outer and inner sleeve members, and said outer and inner sleeve members have opposed, confronting gripping surfaces engageable with said cable when said outer sleeve member is deformed into crimping engagement with said cable.

14. A fitting according to claim 13 wherein said gripping surfaces on said outer sleeve member are defined by axially spaced, endless sealing ribs.

15. A fitting according to claim 13 wherein said gripping surfaces on said inner sleeve member are defined by axially spaced serrations.

16. A fitting according to claim 12 wherein said outer sleeve member and said crimping member include releasable locking means therebetween for releasably mounting said crimping member on an external surface of said outer sleeve member.

17. A fitting according to claim 16 wherein said releasable locking means includes a first locking member projecting radially inwardly from said inner crimping surface portion and a second locking member projecting radially inwardly from en external wall surface of said outer sleeve member.

18. A connector for connecting a coaxial TV cable to a terminal wherein said cable has an outer resilient jacket, inner and outer spaced electrically conductive portions and wherein said connector has a fastener for connection to said terminal and a body provided with inner and outer concentric sleeve members with axially spaced sealing ribs on an inner surface of said outer sleeve member for insertion of said inner electrically conductive portion within said inner sleeve member and insertion of said outer electrically conductive portion between said inner sleeve member and said outer sleeve member, the improvement comprising:

said outer sleeve member having a thin-wailed sleeve portion and a relatively thick-walled sleeve portion tapering from said thin-walled portion toward an entrance end for insertion of said cable; and an annular crimping member having a first inner tapered annular surface portion at least as great as an outer diameter of said outer sleeve member and disposed in outer surrounding relation to said outer sleeve member, and a second inner tapered annular surface portion converging rearwardly from said first inner tapered annular surface portion wherein slidable axial advancement of said crimping member with respect to said outer sleeve member will impart inward radial deformation to said outer sleeve member into sealed engagement with an external surface of said cable.

19. A connector according to claim 18 wherein said outer sleeve member has an external tapered surface portion and said crimping surface portion is tapered at an angle substantially corresponding to said external surface portion.

20. A connector according to claim 18 wherein said crimping member has a circular rib projecting radially inwardly from said inner tapered annular surface portion.

21. A connector according to claim 20 wherein said outer sleeve member has an external shoulder and an external tapered surface portion converging rearwardly from said external shoulder.

22. A connector according to claim 20 wherein said first inner tapered annular surface portion extends from a first diameter as least as great as an outer diameter of said outer sleeve member to a second diameter less than said outer diameter of said outer sleeve member.

23. A connector according to claim 22 wherein said second inner tapered annular surface portion converges rearwardly from said first inner tapered annular surface portion.

24. A connector according to claim 20 wherein said second inner tapered annular surface portion converges at a progressively increased angle with respect to said first inner tapered annular surface portion.

25. A connector according to claim 18 wherein said crimping member includes a third inner tapered annular surface portion diverging rearwardly from said second inner tapered annular surface portion.

* * * * *